United States Patent [19]

Hoermeyer et al.

[11] Patent Number: 4,582,591

[45] Date of Patent: Apr. 15, 1986

[54] PROCESS FOR THE SEPARATION OF RESINOUS SUBSTANCES FROM COAL-BASE HEAVY OILS AND USE OF THE FRACTION OBTAINED

[75] Inventors: Heinrich Hoermeyer, Essen; Juergen Stadelhofer, Dortmund; Heinrich Louis, Duisburg; Wolfgang Brueggemann, Castrop-Rauxel, all of Fed. Rep. of Germany

[73] Assignee: Rütgerswerke Aktiengesellschaft, Frankfurt, Fed. Rep. of Germany

[21] Appl. No.: 637,934

[22] Filed: Aug. 6, 1984

[30] Foreign Application Priority Data

Sep. 29, 1983 [DE] Fed. Rep. of Germany ..... 3335316

[51] Int. Cl.[4] ..... C10C 1/18; C10C 3/08; C10C 3/00

[52] U.S. Cl. ..... 208/45; 208/309; 208/314; 208/87

[58] Field of Search ..... 208/45, 309, 314, 87; 423/447.1, 447.4

[56] References Cited

U.S. PATENT DOCUMENTS

| | | | |
|---|---|---|---|
| 3,153,626 | 10/1964 | Kulik | 208/45 |
| 4,089,934 | 5/1978 | Akiyoshi et al. | 208/45 |
| 4,127,472 | 11/1978 | Migitaka et al. | 208/45 |
| 4,184,942 | 1/1980 | Angier et al. | 208/45 |
| 4,208,267 | 6/1980 | Defendorf | 208/45 |
| 4,259,171 | 3/1981 | Stadelhofer et al. | 208/45 |
| 4,277,324 | 7/1981 | Greenwood | 208/45 |
| 4,318,824 | 3/1982 | Turner | 208/45 |

*Primary Examiner*—John Doll
*Assistant Examiner*—Helane Myers
*Attorney, Agent, or Firm*—Beveridge, DeGrandi & Weilacher

[57] ABSTRACT

Heavy oil derived from coal is diluted with organic solvent to a content of less than 10 weight percent of toluene-insoluble material. The mixture is then mixed with a non-aromatic solvent in a ratio of 1:3 to 5:1. With slow stirring of the heavy phase at a temperature of between 50° and 200° C., this mixture is separated into a pumpable TI-poor and a pumpable TI-rich fraction under the action of gravity, with a settling-surface load of up to 1 metric ton/$m^2$ hour. No $\beta$-resins are precipitated from these fluid fractions. No tacky, rubber-like sediment is formed from the TI-rich fraction. The fractions are distillatively separated from the solvents, which can be reused. The TI-poor fraction can be used, for example, as a carbon-black oil component or can be processed further to an impregnating agent for carbon shapes. Binders for carbon shapes or cokes are obtained from the TI-rich fraction.

12 Claims, No Drawings

PROCESS FOR THE SEPARATION OF RESINOUS SUBSTANCES FROM COAL-BASE HEAVY OILS AND USE OF THE FRACTION OBTAINED

The invention relates to a process for the separation of predominantly dissolved resinous substances from coal-base heavy oils, in which two fluid fractions are obtained, of which one contains only a small proportion of toluene-insoluble substances (TI), while the toluene-insoluble material (TI) is enriched in the other, and to the use of these fractions.

Heavy oils obtained from coal, particularly coal liquefaction products and tars from the gasification or coking of lignite and coal, are refined by distillative processing. This thermal processing route is restricted to the vaporizable portion of the heavy oils and is limited by their decomposition temperature. The remaining residue contains all ash, coke, and coal components not previously removed and the high-molecular solids initially present therein or those that are newly formed.

The quinoline-insoluble solids (QI) present in the residues are undesirable for many further processing stages and are therefore removed by mechanical separation processes, as far as possible. The separation effect is achieved either on the basis of the particle size, as in filtration, or primarily on the basis of the higher density of the solids, as in centrifugation. It is also known to agglomerate the solid particles by the addition of a promoter liquid, so that they can be removed from the residues under the action of gravity, by simple settling (German Patent No. 2,810,332).

After removal of the promoter liquid by distillation, the almost QI-free residues are used predominantly for the production of highly anisotropic carbonaceous material. To achieve the highest possible carbon yield, an effort is made in the known processes to keep the loss of $\beta$ resins (TI-QI) as low as possible. This also has the advantage that the QI-rich residue is formed as an easy-to-handle granulatable solid (German No. OLS 3,112,004) or as a non-tacky suspension (German No. OLS 2,355,606). The separation of the toluene-insoluble material can be carried out only with very great difficulty particularly in the case of a high content of $\beta$-resins, such as is present in high-temperature coal tars. Upon precipitation, the $\beta$-resins form a tacky, rubber-like mass with the quinoline-insoluble solids, which settles at the bottom of the settling tank and in the pipes and can be removed only mechanically.

An analytical method for determination of the toluene-insoluble material is known, which is also suitable for separation of the $\beta$-resins under laboratory conditions. However, this is unsuitable for conversion to a commercially usable process, because of the required large solvent excess of approximately 70 parts by weight of solvent per part by weight of heavy oils.

For the production of high-grade electrode binders, pitches with a high content of $\beta$-resins are required which, in addition, do not have an excessively low content of quinoline-insoluble material.

Although additional $\beta$-resins can be produced in the heavy oils by means of a gentle thermal treatment, a simultaneous production of QI, which is undesirable, cannot be prevented. Furthermore, thermal processes of this type are very expensive. No mechanical separation processes for increasing the TI concentration are known.

For the production of abrasion-resistant, hard cokes with a high bulk density, such as are used, for example, for the carburization of steel and cast iron, hard pitches with a high QI content and high coking residue are required. Pitches of this type have been produced in the past from normal pitches by thermal treatment and blowing with air and have been coked in horizontal chamber coking ovens.

It is known, on the other hand, that pitches with a low TI content and a high Bureau of Mines Correlation Index represent an excellent carbon-black oil component. German Patent Nos. 2,547,679 and 2,560,019 describe processes for the production of carbon-black raw materials of this type. As decribed, the toluene-insoluble material is removed in a high-speed centrifuge or with a very fine filter. Aside from the fact that the efficiency of a centrifuge depends not only on its speed but also; at least, on its diameter and on the free path of the particle to be separated, this method appears unsuitable for industrial use, because of the small difference in density between the $\beta$-resins and the other pitch components. It is also known that $\beta$-resins without previous precipitation, as for example in the analytical method described, cannot be obtained by filtration. Even the separation of the quinoline-insoluble solids is possible industrially only with appropriate filter aids, with the residue being discarded as waste. Although the known processes show that high-grade raw materials for carbon black can be obtained from almost TI-free pitches mixed with steam cracker oils or anthracene oil, the described processes for separation of the toluene-insoluble material cannot be carried out industrially, at least in the case of pitches with a high $\beta$-resin content.

For the production of impregnating agents for shaped carbon articles, aromatic residue oil of low viscosity and with a high coking residue are desired. Here again, heavy oils with a low TI content, obtainable from coal, are suitable starting materials.

The task therefore existed of separating heavy oils obtainable from coal into two fluid fractions by means of solvents or solvent mixtures easily removable by distillation, with one fraction containing only small amounts of toluene-insoluble, components (TI) and the other containing an increased concentration of toluene-insoluble material, and of indicating suitable possible uses for both fractions.

This task is solved, according to the invention, by the fact that the content of toluene-insoluble material (TI) in the heavy oil used, which is obtained from coal, is adjusted to less than 10 weight %, preferably to less than 5 weight %, with an aromatic solvent, and the mixture is mixed with a non-aromatic organic solvent in a ratio of 1:3 to 5:1 and is separated into a TI-poor and a TI-rich fraction with stirring of the heavy, TI-rich phase with a peripheral stirrer speed of 0.5 to 6.0 meter/sec at a temperature of between 50 and 200° C., preferably between 50 and 100° C., under the action of gravity, with a settling-surface load of up to 1 metric ton/meter$^2$ hour.

The aromatic solvent can be added to the heavy oil before or together with the non-aromatic solvent. The mixing is problem-free. Thus, for example, a static mixer can be used. However, mixing in a centrifugal pump is also sufficient, if the solvents are uniformly metered into the product to be used before it reaches the pump.

In principle, all conventional organic solvents can be used, aromatic solvents for dilution of the heavy oil and the non-aromatic solvents, which are poor solvents for aromatic compounds, for precipitation of the β-resins. It is advantageous, however, to use solvents whose boiling point is lower than the initial boiling point of the heavy oil, in which case the mixture should, if possible, show a boiling gap. In this way, in the distillative recovery of the solvents, an almost complete separation of the solvents from the heavy oil fractions is achieved and the solvent loss is minimized. The recovered solvents are reused.

For heavy oils with an initial boiling point of approximately 200° C., a solvent combination of toluene and methanol has proved particularly satisfactory, with the best results being achieved with a ratio of solvent mixture to heavy oil of at least 1:1 and an excess of methanol. In order to obtain a good flowability of the TI-rich fraction, the content of toluene-insoluble material in the fraction must not exceed 50 weight %.

For heavy oils with an initial boiling point of approximately 300° C. and above, a solvent combination of methylnaphthalene-oil and benzine has proved suitable, but other solvent combinations such as, for example, a combination of xylene and n-heptane, serve the same purpose. For cost reasons, however, fractions are preferred to the pure substances.

It has been found, surprisingly, that, by means of slow stirring of the heavy phase, using the low peripheral speeds for the preferably used stirrers with large diameter in relation to the tank diameter, such as flat-blade paddle stirrers, paddle stirrers, or anchor stirrers, and the higher speeds for stirrers with small diameter, such as propeller or turbine stirrers, not only is the formation of tacky, rubber-like substances prevented, but the separation of the toluene-insoluble material is also increased. The precipitation of resinous components from the light phase, which is also slowly moved at the same time, is supported and the separation of the TI-poor fraction from the heavy phase is increased. The stirrer speed in this case must remain far below the critical speed, to prevent a mixing of the two phases.

It has also been found that the ratio of the tank diameter (d) to the filling level (h) also has an effect on the separation of the toluene-insoluble material. A ratio $d/h \geqq 2$ is particularly advantageous.

By means of the process according to the invention, it is possible to reduce the residues from the processing of coalbase heavy oils at a justifiable expense and, in part, to process these further to valuable products. In this way, new areas of application are opened up for these residues, which had been previously reserved for oils obtained by distillation.

The process according to the invention will be explained in greater detail with reference to several discontinuous embodiments, without being restricted to these. The process can also be carried out continuously with the same result, in which case the mixture of heavy oil and solvents is preferably fed into the stirred tank in the region of the interphase.

EXAMPLE 1

Forty parts by weight of a topped high-temperature coal tar (initial boiling point=224° C., TI=8.1 wgt. %, QI=1.9 wgt. %, ash content=0.1 wgt. %) are initially dissolved in 30 parts by weight of toluene at 60° C. and are mixed with 30 parts by weight of methanol by means of a static mixer. The mixture is passed into a cylindrical stirred tank with an impact bottom (D/h=2.5), in which an anchor stirrer rotates in the vicinity of the bottom with a peripheral speed of 0.8 meter/sec. The settling-surface load is 0.15 metric ton/m$^2$ hour. The settling process under stirring at 60° C. is complete after one hour. After the phase separation, the two fractions are distilled discontinuously at a head pressure of 93 mbar up to a head temperature of 90° C. in order to recover the solvents. The remaining residue consists of 26.3 parts by weight of a TI-poor fraction, which still contains 0.2 weight % of toluene but no methanol, and 13.8 weight % of a TI-rich fraction, in which no solvent residues can be detected. The analytical data are shown in Table 1.

The TI-poor fraction has a Bureau of Mines Correlation Index of 175 and is used as a raw material for carbon black. Any suitable known process for making carbon black may be used.

Standard rubber carbon blacks are produced from this material in a furnace reactor in 44.2 % yield.

The TI-rich fraction is processed by distillation in the usual manner like topped tar. In this case, a residue of only 33.8 weight %, based on the topped tar used, is obtained, as compared with 59.3 weight % of the usual purely distillative processing. The residue has a softening point according to Kraemer-Sarnow (SP) of 73° C. (K.-S.).

From this, a hard pitch with a softening point of 172° C. (K.-S.) is produced by blowing in a yield of 82 weight %, and this is coked in a horizontal chamber coking oven for 24 hours at 1050° C. to a macroscopically almost isotropic coke with a bulk density of 520 kg/m$^3$ and a Micum drum resistance of $M_{10}$=8.2 weight %. The coke yield, based on the pitch residue (normal pitch) is 62 weight %.

EXAMPLE 2

Ten parts by weight of normal coal tar pitch (SP=72° C. (K.-S.), TI=19.2 weight %, QI=6.5 weight %, ash content=0.18 weight %) are diluted with 10 parts by weight of methylnaphthalene oil (boiling range 235° to 265° C.) and a mixture with 16 parts by weight of solvent naphtha (boiling range 140° to 170° C.) is transported into a stirred tank with a flat bottom d/h=3.2) by means of a centrifugal pump. A cross beam stirrer rotates in the vicinity of the bottom at a peripheral speed of 1 meter/sec. The settling-surface load is 0.2 metric ton/m$^2$ hour. After settling for two hours with stirring at 73° C., the mixture has separated into a light and a heavy phase. Twenty-five parts by weight of solvent from the upper phase and 1 part by weight of solvent from the lower phase are distilled off discontinuously at a head pressure of 100 mbar and a liquid-phase temperature of up to 288° c. In this manner, 6 parts by weight of a TI-rich fraction and 4 parts by weight of a TI-poor fraction are obtained, whose analytical data are shown in Table 1.

The 4 parts by weight of the TI-poor fraction are mixed with 4 parts by weight of filtered anthracene oil. The Bureau of Mines Correlation Index of this mixture has a value of 179. Standard rubber carbon blacks are produced from this in a furnace reactor in 45.1 % yield.

The 6 parts by weight of the TI-rich fraction are mixed with 3 parts by weight of normal coal tar pitch with the same analytical data as the pitch to be extracted, in the liquid state, and are processed to electrode binder by means of a gentle head distillation. A binder with a softening point of 90° C. (K.-S.), a QI content of 10.2 weight %, a β-resin content of 25.3 weight %, an ash content of 0.28 weight %, and a coking residue (Conradson) of 52.6 weight % is obtained in 92 % yield.

EXAMPLE 3

Ten parts by weight of a soft pitch from lignite gasification (SP=34° C. (K.-S.), TI=9.8 weight %, QI=3.1 weight %, ash content =0.1 weight %) are mixed with a solvent mixture of 7 parts by weight of xylene and 16 parts by weight of n-heptane at 85° C. in a tube section by means of a bypass circuit with 90% recycling and are conducted into a tank with a tapered bottom (d/h=2.0), in whose conical part a flat-blade paddle stirrer adapted to the tank geometry moves the heavy phase at a peripheral speed of 0.7 meter/sec. The settling-surface load is 0.4 metric ton/m$^2$ hour. The phase separation is complete within 1 hour at 85° C. Twenty-four parts by weight of solvent and tar oils are distilled off from the light phase at a head pressure of 100 mbar and a liquid-phase temperature of up to 350° C. The remaining 5 parts by weight of distillation residue are almost free of ash and QI and contain only 1.3 weight % of $\beta$-resins. The softening point is 62° C. (K.-S.) and the coking residue 43.1 weight %. The residue is used as an impregnating agent for graphite electrodes for steelmaking.

From the 4 parts by weight of the heavy phase, 0.5 part by weight is distilled off at a head pressure of 100 mbar of a liquid-phase temperature of up to 370° C. The residue, with a softening point of 90° C. (K.-S.) and a coking residue (Conradson) of 54.3 weight %, has an ash content of 0.3 weight %, a QI content of 9.5 weight %, and a $\beta$-resin content of 26.7 weight % and is used as an electrode binder.

It is also possible to use, as the heavy oil, a coal-base product from which the ash components or the quinoline-insoluble material have previously been removed at least in part. It is known to reduce the ash content in heavy oils by centrifugation and to remove the quinoline-insoluble material, at least in part, by filtration, separation, or promoter-accelerated settling. In particular, processes for removal of the quinoline-insoluble material by promoter-accelerated settling can be easily combined with the process according to the invention.

EXAMPLE 4

Twenty parts by weight of normal coal tar pitch as in Example 2 are thermally treated at 250° C. with 9 parts by weight of methylnaphthalene oil (boiling range 235° to 245° C.) and 9 parts by weight of kerosene (boiling range 250 to 300° C.) in a tank with a tapered bottom with a reflux condenser for three hours, with stirring. The mixture is then cooled to 180° C. by pumping through a condenser. After one hour without stirring, a QI-rich fraction (20 weight % of the mixture) has settled on the bottom and is drained off. The 30.4 parts by weight of the remaining fraction (QI=0.04 weight %, TI=7.25 weight %) are mixed with another 7.5 weight % of methylnaphthalene oil and 16.5 parts by weight of kerosene by pumping through the condenser and are cooled to 75° C. The d/h ratio is 2.1 and the flat-blade paddle stirrer rotates at the same speed as in Example 3. After two hours, the mixture has separated into a light and a heavy phase. After distilling off the solvents, 8 parts by weight of a TI-poor fraction with 0.1 weight % of toluene-insoluble material is obtained, which is used as a carbon-black component, along with 7 parts by weight of a TI-rich fraction with a TI content of 31.3 weight %, which is converted to a highly anisotropic green coke, with a yield of 73 weight %, by coking in a delayed coker. After calcination at 1300° C., this coke shows a thermal expansion coefficient of $3.1\times10^{-5}$ $K^{-1}$ between 25° and 200° C.

EXAMPLE 5

(Comparison)

A normal pitch as in Example 2 is used. The extraction is carried out as in that example, but without stirring. No free-flowing heavy phase is formed. The material settling out can be neither dissolved nor completely melted and must therefore be mechanically removed.

Twenty-nine parts by weight are carefully removed from above from the light phase. After only a short time, resinous components already precipitate out, as a result of inadequate separation of the $\beta$-resins. The mixture is distilled in a stirred retort under a pressure of 100 mbar up to a liquid-phase temperature of 275° C. in order to remove the solvents. The pitchlike residue (4 parts by weight) has the analytical data shown in Table 1. A comparison with the analytical data of Example 2 clearly shows the effect of stirring on the separation of the toluene-insoluble material.

EXAMPLE 6

(Comparison)

The experiment is carried out as described in Example 2, except that only 5 parts by weight of solvent naphtha are used. The TI content of the TI-poor fraction, stripped of solvents, is 3.9 weight %. The materials is not suitable as a carbon-black oil component.

TABLE 1

| | TI-poor Fraction After solvent separation | | | TI-rich Fraction after solvent separation | | | | |
|---|---|---|---|---|---|---|---|---|
| Ext. No. | TI (%) | QI (%) | Ash (%) | Sodium (ppm) | TI (%) | QI (%) | Ash (%) | Coke (%) |
| 1 | 0.3 | <0.1 | <0.01 | 7 | 24.1 | 5.8 | 0.5 | 56.0 |
| 2 | 0.2 | <0.1 | <0.01 | 8 | 32.0 | 10.6 | 0.3 | 54.8 |
| 5 | 2.2 | 0.2 | <0.01 | 15 | not homogeneous | | | |

The % values are % by wgt.
TI = toluene-insoluble material.
QI = quinoline-insoluble material.
Coke = coking residue according to Conradson.

We claim:

1. A process for the separation of resinous substances from coal-base heavy oils comprising mixing a heavy oil obtained from coal with an aromatic solvent and extracting so that the content of toluene-insoluble materials (TI) in the heavy oil is less than 10 weight %, then adding thereto a non-aromatic organic solvent in a ratio of 1:3 to 5:1, and separating the resulting mixture into a TI-poor and a TI-rich fraction with stirring of the heavy, TI-rich phase at a peripheral stirrer speed of 0.5 to 6 meter/sec at a temperature of between 50° and 200° C., under the action of gravity, with a settling-surface load of up to 1 metric ton/m$^2$ hour.

2. The process according to claim 1, further comprising distilling off the solvents to obtain a TI-rich fraction wherein the toluene-insoluble material does not exceed 50 weight %.

3. The process according to claim 1, further comprising using a heavy oil with an initial boiling point of approximately 200° C., toluene as the aromatic solvent and methanol as the non-aromatic solvent, with the ratio of solvent to heavy oil having a value equal to or greater than 1 and the ratio of methanol to toluene having a value greater than or equal to 1.

4. The process according to claim 1, further comprising using a heavy oil with an initial boiling point of at least approximately 300° C., methylnaphthalene oil as aromatic solvent and benzine as the non-aromatic solvent.

5. The process according to claim 1, further comprising carrying the process out in a tank wherein the ratio of the tank diameter (d) to the filling level (h) for the settling tank (d/h) has a value greater than or equal to 2, and adding the aromatic and the non-aromatic solvent simultaneously.

6. The process according to claim 1, further comprising using a heavy oil from which the ash components of the quinoline-insoluble solids have previously been removed.

7. The process according to claim 1, further comprising using a heavy oil where the TI content is less than 5 weight %.

8. The process according to claim 1, further comprising carrying out the separation of the TI-poor and TI-rich fraction at a temperature of 50° to 100° C.

9. The process according to claim 1, further comprising removing solvents from and distilling off of an additional oil fraction, and utilizing the product as an impregnating agent for shaped carbon articles.

10. The process according to claim 1, further comprising removing solvents from and recovering the product for use as a carbon-black oil.

11. The process according to claim 1, further comprising removing solvents from and distilling off of an additional oil fraction, and recovering the product for use as a binder for carbon shapes.

12. The process according to claim 1, further comprising removing solvents from and recovering the product for use as a feedstock for coke production.

* * * * *